US007427057B1

(12) United States Patent
Kampman et al.

(10) Patent No.: US 7,427,057 B1
(45) Date of Patent: Sep. 23, 2008

(54) CONTROL VALVE ASSEMBLY OF A CARBURETOR AND METHOD OF ASSEMBLY

(75) Inventors: Erin E. Kampman, Cass City, MI (US); George M. Pattullo, Caro, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 320 days.

(21) Appl. No.: 11/361,592

(22) Filed: Feb. 24, 2006

(51) Int. Cl.
*F02M 17/38* (2006.01)

(52) U.S. Cl. ..... 261/52; 137/15.25; 261/64.1; 261/65

(58) Field of Classification Search ..... 261/38, 261/52, 64.1, 65; 137/15.25
See application file for complete search history.

(56) References Cited

U.S. PATENT DOCUMENTS

| | | | | |
|---|---|---|---|---|
| 1,201,240 | A * | 10/1916 | Benjamin | 137/483 |
| 2,595,720 | A * | 5/1952 | Snyder | 261/50.2 |
| 2,595,721 | A * | 5/1952 | Snyder | 261/50.2 |
| 3,275,306 | A * | 9/1966 | Phillips | 261/35 |
| 3,852,379 | A * | 12/1974 | Shishido et al. | 261/23.2 |
| 4,616,518 | A * | 10/1986 | Nusser | 74/96 |
| 6,641,118 | B2 * | 11/2003 | Schliemann | 261/52 |
| 6,688,585 | B2 * | 2/2004 | Braun et al. | 261/35 |
| 6,708,959 | B1 | 3/2004 | Dow | |
| 6,848,405 | B1 | 2/2005 | Dow et al. | |
| 7,028,993 | B2 * | 4/2006 | Burns | 261/35 |
| 2003/0071371 | A1 * | 4/2003 | Morris | 261/65 |

FOREIGN PATENT DOCUMENTS

| | | | | |
|---|---|---|---|---|
| JP | 59-224452 | A * | 12/1984 | 261/65 |

* cited by examiner

*Primary Examiner*—Richard L Chiesa
(74) *Attorney, Agent, or Firm*—Reising, Ethington, Barnes, Kisselle, P.C.

(57) ABSTRACT

A combustion engine carburetor has a control valve assembly that generally controls flow through a fuel-and-air mixing passage extending through a body of the carburetor. The control valve assembly has at least one valve preferably of a butterfly-type having a shaft that extends transversely across the fuel-and-air mixing passage and journaled for rotation in the body about a rotation axis. The shaft has opposite trailing and leading end portions that project from generally opposing sides of the carburetor body. Axial movement of the shaft with respect to the body is limited by an axial retention feature that preferably has a radially enlarged end cap formed unitarily to the trailing end portion and a coupler snap fitted to the leading end portion. Preferably, the coupler is formed unitarily at least in part to a control lever of the valve having a rotation restriction feature that prevents rotation of the control lever with respect to the shaft and is orientated in such a way to the leading end portion so that the control lever and at least a part of the coupler is removable from the shaft.

34 Claims, 5 Drawing Sheets

CONTROL VALVE ASSEMBLY OF A CARBURETOR AND METHOD OF ASSEMBLY

FIELD OF THE INVENTION

The present invention relates to a combustion engine carburetor and more particularly to a control valve assembly of the carburetor and method of assembling the same.

BACKGROUND OF THE INVENTION

Typical carburetor control valve assemblies have a throttle valve for control of engine speed and/or power, and a choke valve to facilitate cold engine starts. Often, the throttle valve is mechanically linked to the choke valve to further improve engine start reliability. Although less common, some control valve assemblies of a carburetor comprise only one valve, typically known as a throttling choke valve. For applications having both a choke valve and a throttle valve, the throttle valve typically has a metallic throttle lever for rotation of the throttle valve from slow idle to wide open positions. A stop is engaged by the throttle lever to restrict maximum opening of the throttle valve. Current choke valves have a metallic choke lever for manual or automatic rotation of the choke valve from full open for normal engine operation to substantially closed for cold engine starts. In some known applications, the metallic choke lever includes a cam surface that contacts a metallic cam member of the throttle valve typically engaged to an opposite end of the throttle shaft from the throttle lever.

The throttle lever, cam member and choke lever are attached to respective metallic throttle and choke shafts by either a threaded fastener or by swaging over an end portion of the shaft(s) extending through the levers and member. The throttle and choke valve heads are typically discs such as that of a butterfly valve located in the fuel-and-air mixing passage, and with the disks attached to the shafts by threaded fasteners. The machined or stamped components are relatively expensive to produce. Further, the use of threaded fasteners to connect the valve head and/or levers to the shaft, and/or the swaging of the shaft onto the levers greatly increases the cost, difficulty, time and labor required to assemble the control valve assembly in the carburetor body.

In some applications such as that taught in U.S. Pat. No. 6,708,959, issued Mar. 23, 2004, assigned to Walbro Engine Management, L.L.C., and incorporated herein by reference in its entirety, a plastic throttle lever connects to a plastic throttle shaft and the valve head or disc press fits into a longitudinal slot of the plastic shaft. As is commonly known in the art, a coiled torsion spring disposed axially on and engaged between the throttle lever and carburetor body rotationally biases the throttle valve toward an idle position. Although this design is known to reduce manufacturing costs by switching to snap-fitted plastic components, the natural tendency of the spring to expand axially as it resiliently coils when the throttle valve is rotated can loosen or dislodge the snap fitted throttle lever from the throttle shaft.

SUMMARY OF THE INVENTION

A combustion engine carburetor has a control valve assembly that generally controls fluid flow through a fuel-and-air mixing passage extending through a body of the carburetor. The control valve assembly has at least one valve preferably of a butterfly-type having a shaft that extends transversely across the fuel-and-air mixing passage and is journaled for rotation in the body about a rotation axis. The shaft has opposite leading and trailing end portions that project from generally opposite sides of the carburetor body. To prevent the shaft from passing through the body in one direction, a radially enlarged end cap is preferably connected unitarily to the trailing end portion. Preferably, at least one control lever removably attaches to either or both end portions of the shaft. A rotation restriction feature is carried between the control lever and respective end portions that requires circumferential alignment of the control lever with the respective end portion before axially sliding the control lever over the respective end portion during assembly.

To achieve axial retention of the shaft to the body and of sufficient strength, the control valve assembly has a coupler preferably snap fitted to the leading end portion. The coupler preferably has at least one flex arm preferably extending unitarily and axially from one of the control levers. The snap fit is achieved via a tang and a recess carried between a distal end of the flex arm and the leading end portion. The prescribed circumferential alignment of the at least one control lever with the rotating shaft is generally a non-circular relationship that resists rotation of the shaft with respect to the lever when mounted, yet during assembly of the lever to the shaft, permits unobstructed axial movement of the lever with respect to the shaft. Preferably, this non-circular relationship is at least one radially inward facing planar surface carried by the control lever, but preferably not by the resilient flex arms of the coupler for strength. Either or both of the end portions carry at least one axially extending flat side that faces radially outward to lay in contact with the respective planar surfaces of the at least one control lever.

Preferably, one of the at least one control levers is an interfacing cam member of a butterfly-type throttle valve that forms unitarily to the flex arm of the coupler as one unitary piece. In addition to the cam member, the throttle valve also has a throttle lever as another of the control levers engaged to and aligned circumferentially with the trailing end portion of the shaft and located axially between the carburetor body and the enlarged unitary cap. Similar to the cam member, the throttle lever is circumferentially aligned to the trailing end portion preventing the throttle lever from rotating with respect to the shaft. When assembled, the enlarged end cap prevents the throttle lever from axially slipping off of the trailing end portion. Preferably, a coiled torsion spring is wound about the shaft and disposed axially between and engaged to the body and the throttle lever for biasing the throttle control valve assembly into a substantially closed or idle position.

During assembly, the throttle lever is loosely slid over the leading end portion of the shaft that does not have the enlarged unitary cap, is circumferentially aligned to the opposite trailing end portion and then snugly slid axially onto the trailing end portion until it abuts axially against the enlarged unitary cap of the shaft. The coiled torsion spring is then slid over the leading end portion and slid axially until it engages the throttle lever. The leading end portion of the shaft is then inserted first into the body of the carburetor and transversely through the fuel-and-air mixing passage, until the leading end portion projects from the opposite side of the body and whereupon an opposite end of the torsion spring engages the carburetor body. The cam member is then aligned circumferentially to the projecting leading end portion of the shaft and slid axially over the leading end portion as the resilient flex arms flex radially outward. When the cam member is axially aligned to the shaft, the tang preferably carried by the flex arm snap fits into the recess, which is preferably a continuous groove, of the leading portion as the flex arm moves radially inward and toward its natural state.

Objects, features, and advantages of this invention include a control valve assembly having the required structural strength to utilize plastic components as opposed to metal. The plastic control valve assembly is light weight, resistant to corrosion, inexpensive to manufacture and assemble, eliminates the use of machined or stamped metal components, and eliminates the use of threaded fasteners and/or swaging components together. Moreover, the valve assembly shaft can be plastic injection molded with the unitary end cap for axial retention as one piece, and components such as a throttle lever and cam member can be easily interchanged for specific carburetor applications. The control valve assembly is also reliable, durable, rugged and in service has a long and useful life.

BRIEF DESCRIPTION OF THE DRAWINGS

These and other objects, features and advantages of this invention will be apparent from the following detailed description, appended claims and accompanying drawings in which:

DETAILED DESCRIPTION OF PRESENTLY PREFERRED EMBODIMENTS

Figure 1:
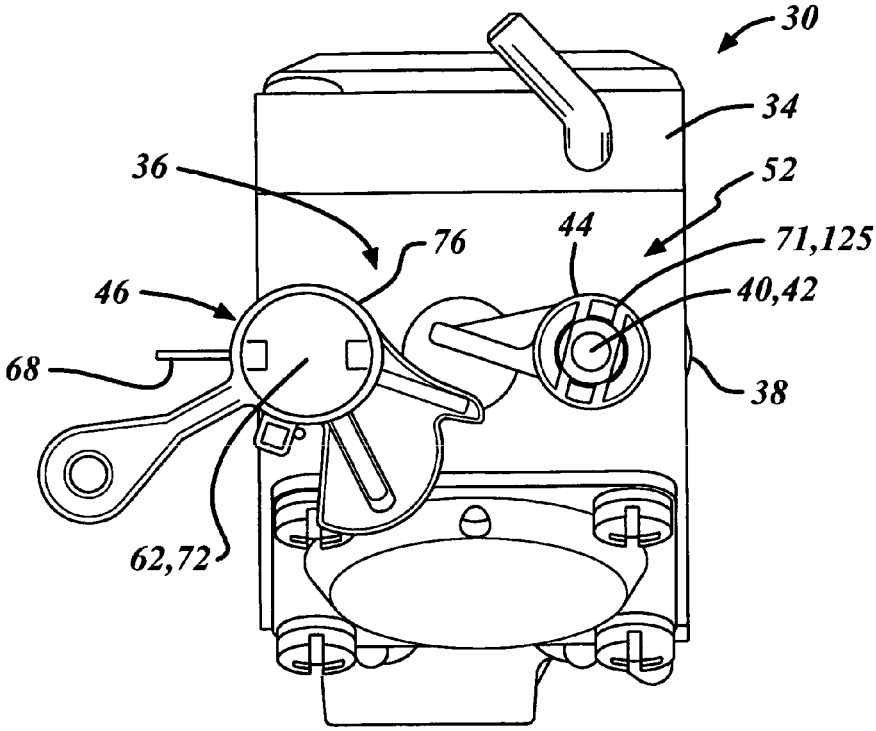
FIG. 1 is a perspective view of a combustion engine carburetor embodying the present invention and illustrating a control valve assembly having a choke lever of a choke valve and an interfacing cam member of a throttle valve.
Figure 2:
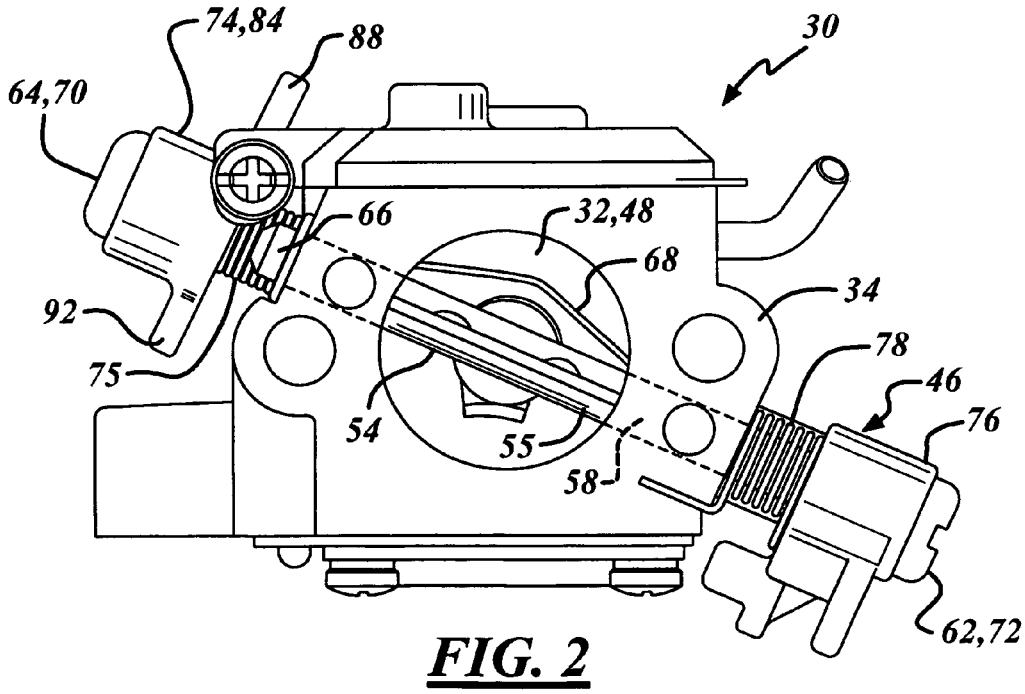
FIG. 2 is an end view of the carburetor illustrating the choke valve.

Referring in more detail to the drawings, FIGS. 1-4 illustrate a carburetor 30 having a fuel-and-air mixing passage 32 extending through a carburetor body 34 preferably made of metal. The fluid flow through the mixing passage 32 and to an internal combustion engine (not shown) is generally controlled by a control valve assembly 36 preferably having both a butterfly-type throttle valve 52 and a choke valve 46 constructed and arranged to control the mixing and flow of fuel and air through the mixing passage 32. The choke valve 46 of the control valve assembly 36 is preferably located in an upstream region 48 of the fuel-and-air mixture passage 32 for restricting incoming air flow to produce a richer mixture of fuel-and-air during cold starts of the engine (see FIG. 2). Immediately downstream of the choke valve 46 is a venturi (not shown) for general mixing of fuel-and-air prior to flowing into a downstream region 50 of the fuel-and-air mixing passage 32 as known in the art. The throttle valve 52 is located in a downstream region 50 and generally controls the amount of fuel-and-air mixture flowing to the operating engine thus generally controlling speed and power.

Figure 4:
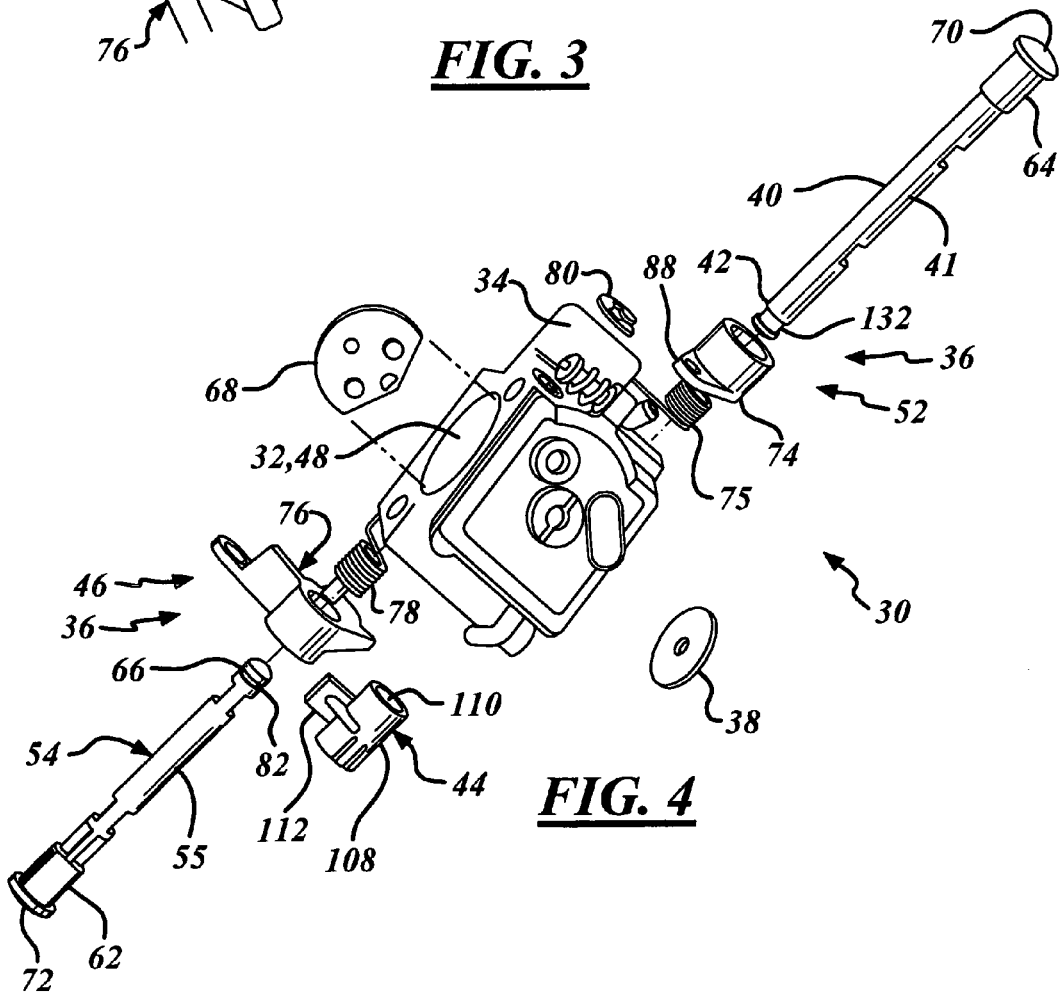
FIG. 4 is an exploded perspective view of the carburetor.
Figure 5:
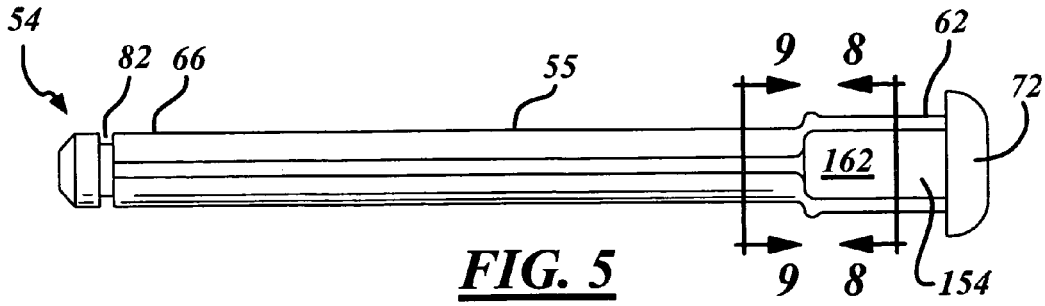
FIG. 5 is a side view of a choke shaft of the choke valve.
Figure 6:
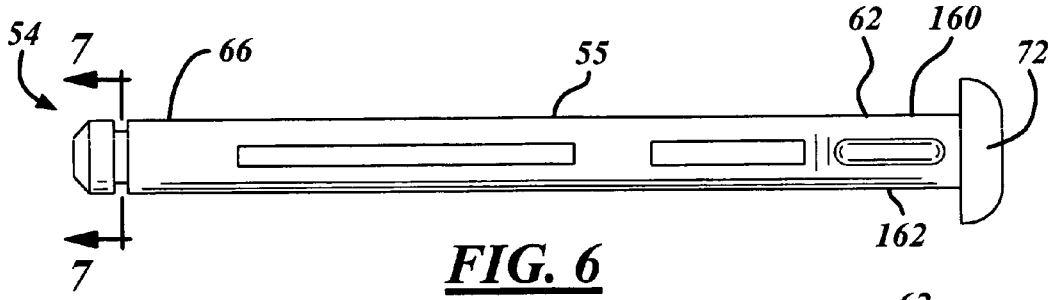
FIG. 6 is a side view of the choke shaft rotated ninety degrees with respect to FIG. 5.
Figure 7:
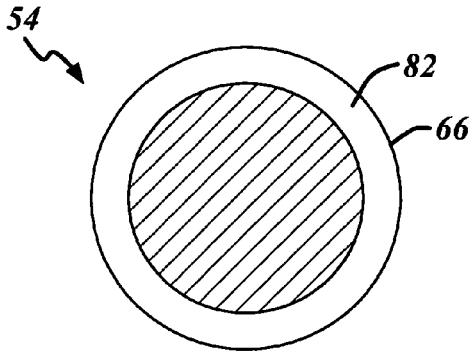
FIG. 7 is a cross section of the choke shaft taken along line 7-7 of FIG. 6.
Figure 8:
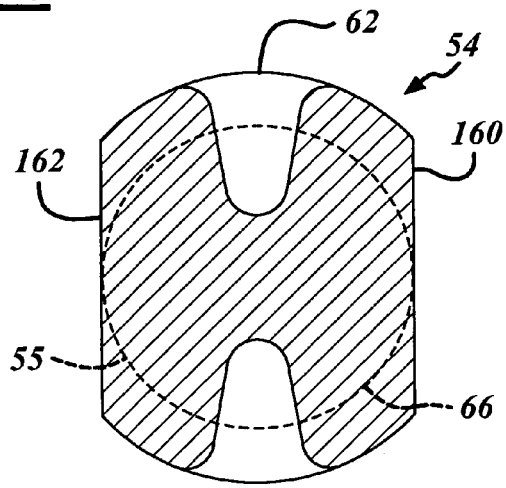
FIG. 8 is a cross section of the choke shaft taken along line 8-8 of FIG. 5.
Figure 9:
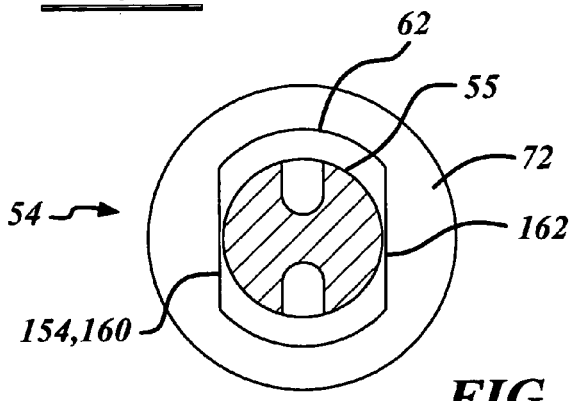
FIG. 9 is a cross section of the choke shaft taken along line 9-9 of FIG. 5.

As best illustrated in FIG. 4, the choke valve 46 has a rotating shaft 54 having a substantially cylindrical mid-section 55 received rotatably in a through-bore 58 of the body 34 that extends transversely across the upstream region 48 of the fuel-and-air mixing passage 32. The choke shaft 54 has a leading end portion 66 (with respect to assembly) and an opposite trailing end portion 62. The leading end portion 66 and trailing end portion 62 project outward from generally opposite sides of the carburetor body 34. Preferably, a choke plate or disc 68 engages a mid section 55 of the rotating shaft 54 and thus pivots in the upstream region 48 of the fuel-and-air mixing passage 32 to generally adjustably obstruct the flow of incoming air through the passage.

The mid section 55 extends axially between the leading and trailing end portions 66, 62. Because the choke shaft 54 is axially retained to the body 34, the mid section 55 and plate 68 are able to maintain proper orientation in the upstream region 48 of the mixing passage 32. Axial retention of choke shaft 54 relative to the carburetor body 34 is provided by a radially enlarged cap 72 engaged to trailing end portion 62 and e-clip or split ring retainer 80 removably snap fitted into a continuous groove 82 carried by the leading end portion 66.

A control or choke lever 76 of the choke valve 46 is fixed to the trailing end portion 62 and inward or forward of the cap 72 for rotation in unison with the choke shaft 54. A coiled torsion spring 78 is received on the shaft 54 axially between the carburetor body 34 and choke lever 76 for yieldably biasing the choke valve 46 into an open position for normal/warm operation of the engine. Preferably, the choke valve 46 can be automatically or remotely operated to substantially close the choke valve 46 against the biasing force of the spring 78 for cold engine starts. As illustrated, the choke lever 76 interfaces with a control lever or cam member 44 of the throttle valve 52. One example of a cam interface between a cam member of a throttle valve and a choke lever is disclosed in U.S. Pat. No. 6,848,405, issued Feb. 1, 2005, assigned to Walbro Engine Management, L.L.C., and incorporated herein by reference in its entirety.

Figure 10:
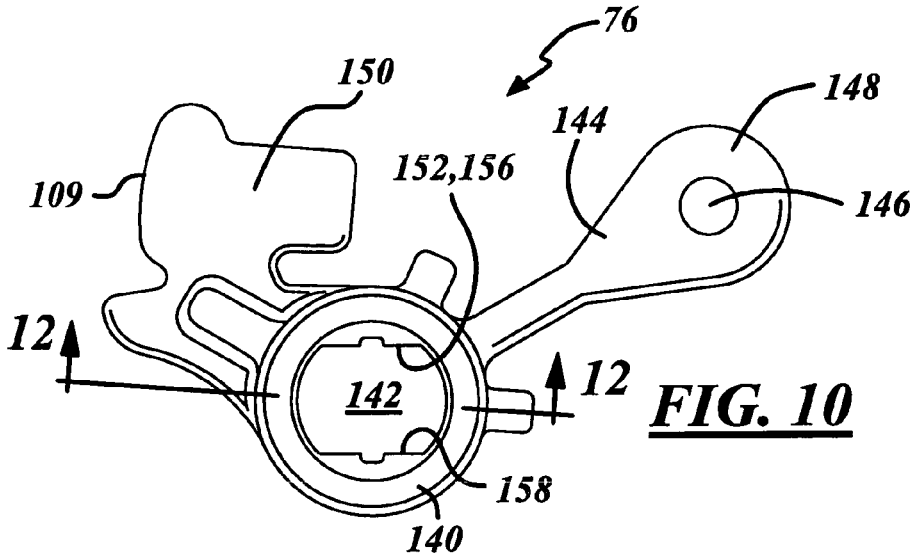
FIG. 10 is a top view of the choke lever.
Figure 11:
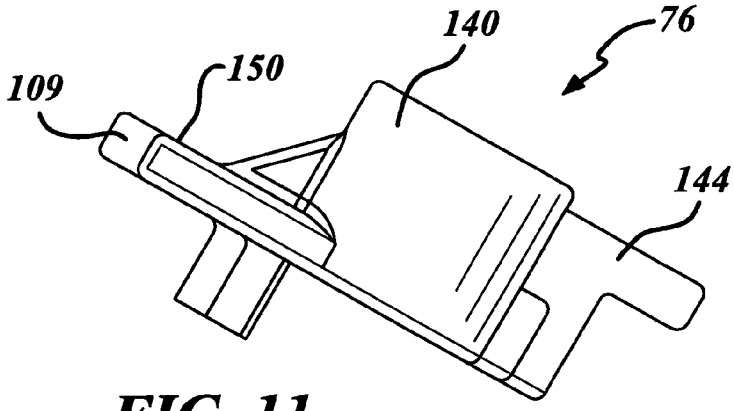
FIG. 11 is a side view of the choke lever.
Figure 12:
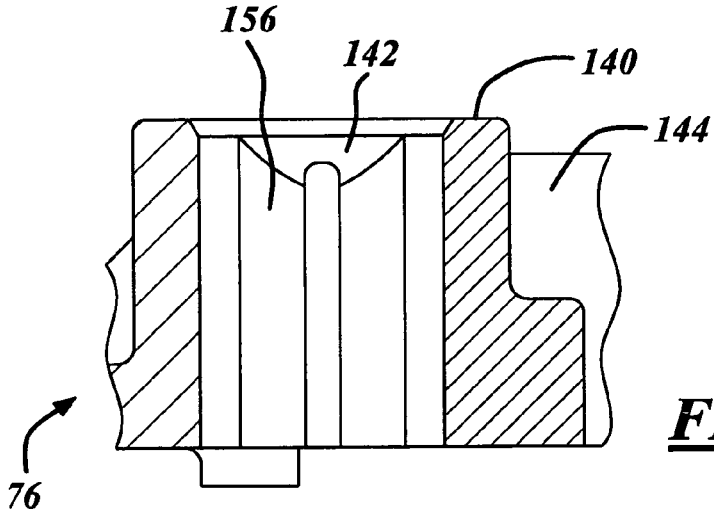
FIG. 12 is a cross section of the choke lever taken along line 12-12 of FIG. 10.

Referring to FIGS. 10-12, the choke lever 76 of the choke valve 46 of the control valve assembly 36 has a cylindrical collar 140 with a non-circular through-hole 142 for receipt of the trailing end portion 62 of the choke shaft 54. An arm 144 of the choke lever 76 projects radially outward from the collar 140 and has a hole 146 at a distal end 148 for pivotal engagement with a Bowden wire (not shown). A peripherally contoured plate 150 carrying a cam surface 109 for control of fuel enrichments also projects radially outward from the collar 140 and is preferably spaced circumferentially from the arm 144. Actuation of the Bowden wire by an end user rotates the biased normally open choke valve 46 to a substantially closed position, thus pivoting the head or plate 68 to obstruct air flow at the upstream region 48 of the fuel-and-air mixing passage 32 to provide a richer mixture of fuel-and-air to the engine.

A rotation restriction feature 152 of the choke valve 46 is carried between the choke lever 76 and the trailing end portion 62 of the choke shaft 54 and serves to rotationally hold-fast the choke lever 76 to the choke shaft 54 while not obstructing axial movement of the choke lever 76 with the shaft during assembling. The rotation restriction feature 152 preferably has two opposing flat faces 156, 158 carried by the collar 140 of the choke lever 76. The faces 156, 158 substantially face radially inward and are orientated substantially parallel to the shaft 54 or axis of rotation. The head end portion 62 of the choke shaft 54 carries two diametrically opposed flat sides 160, 162 of the rotation restriction feature 152 that preferably extend axially to the end cap 72. When the choke lever 76 is assembled to the choke shaft 54, the faces 156, 158 are in tight contact with the respective flat sides 160, 162 of the rotation restriction feature 152 preventing rotation of the choke lever 76 relative to the choke shaft 54.

With the choke lever 76 axially contacting the end cap 72, the choke torsion spring 78 is slightly compressed axially between the choke lever 76 and the carburetor body 34. During operation of the carburetor, when the choke valve 46 is rotated toward the choke or substantially closed position against the biasing force of the coiled torsion spring 78, the windings tighten or retract radially inward thus the spring 78 expands axially and exerts an increasing axial force between the carburetor body 34 and the choke lever 76. This force exerted upon the choke lever 76 pushes the choke lever 76 against the cap 72, thus having a tendency to axially shift the choke shaft 54 in an outward direction from the body 34. This outward axial shift is prevented by the e-clip or split ring retainer 80 removably snap fitted into the continuous groove 82 carried by the leading end portion 66.

As best illustrated in FIG. 4, the throttle shaft 40 of the throttle valve 52 has a substantially cylindrical mid-section 41 extending axially between leading and trailing end portions 42, 64 (with respect to assembly) and received rotatably in a through-bore 56 of the body 34 that extends transversely across the downstream region 50 of the fuel-and-air mixing passage 32. Preferably a throttle plate 38 engages the mid-section 41 of the throttle shaft 40 and thus pivots in the downstream region 50 of the fuel-and-air mixing passage 32 to adjustably obstruct the flow of a fuel-and-air mixture through the passage.

In addition to the cam member 44 engaged to the leading end portion 42, the throttle valve 52 has a control or throttle lever 74 attached for rotation in unison with the throttle shaft 40 at the trailing end portion 64. A coiled torsion spring 75 is received on the shaft 40, and is engaged at one end with the throttle lever 74 and at its other end with the carburetor body 34 to yieldably bias the throttle valve 52 into a slow idle position. The cam member 44 is preferably attached at the leading end portion 42 for rotation in unison with the shaft 40 and preferably contacts directly with the choke lever 76 of the choke valve 46 via a camming interface.

Figure 13:
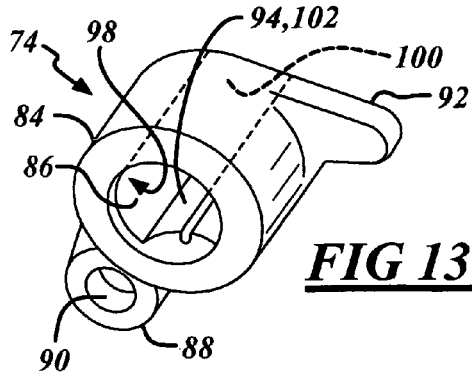
FIG. 13 is a perspective view of a throttle lever of the throttle valve.
Figure 14:
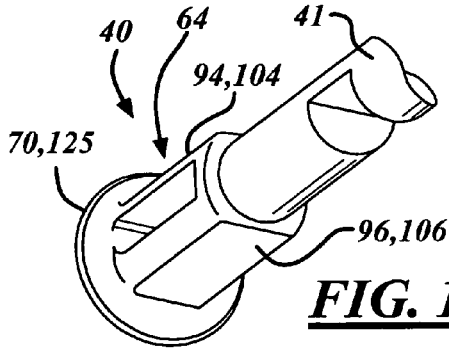
FIG. 14 is a fragmentary perspective view of an end portion of a throttle shaft.

As illustrated in FIG. 13, the throttle lever 74 of the throttle valve 52 has a collar portion 84 that circumferentially surrounds the non-circular trailing end portion 64 (see FIGS. 4 and 14), and a leg 88 that projects radially outward from the collar portion 84. The leg 88 preferably has a hole 90 (see FIG. 13) at a distal end for pivotal engagement with a Bowden wire for remote operation of an accelerator lever or pedal by an end user (not shown). A stop arm 92 also projects radially outward from the collar portion 76 and is preferably spaced circumferentially from the leg 88 for setting the idle position of the throttle valve 52. Actuation of the Bowden wire by the end user rotates the throttle shaft 40 and head or plate 38, for generally moving the throttle valve 52 between an idle position and a wide open throttle position.

Figure 3:
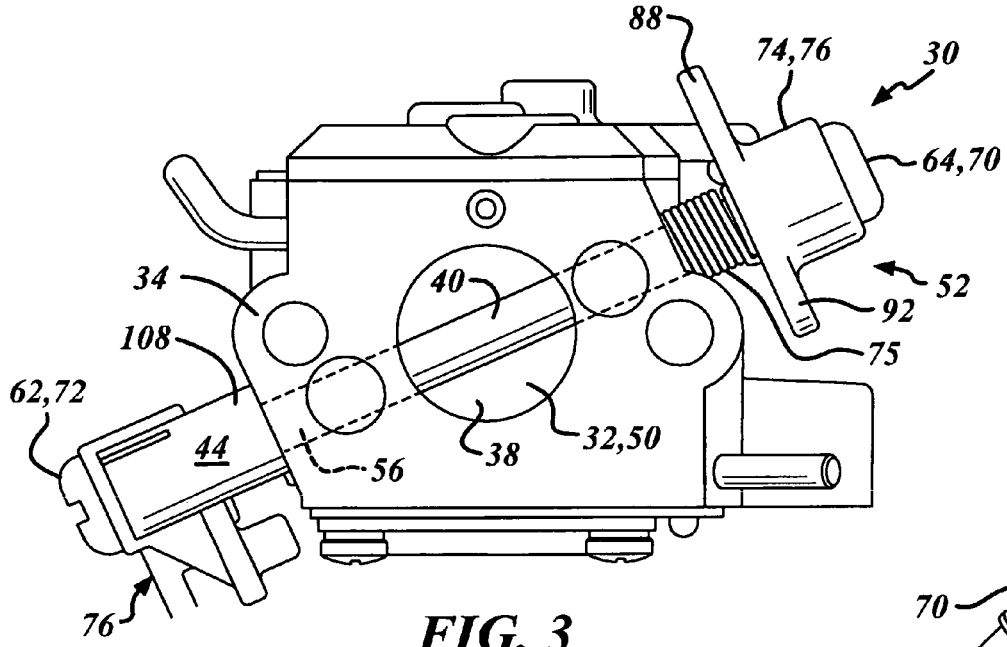
FIG. 3 is an opposite end view of the carburetor illustrating the throttle valve.

As best illustrated in FIGS. 1, 3 and 4, the throttle valve 52 of the control valve assembly 36 preferably has an axial retention feature 125 that prevents unwanted axial displacement of the throttle shaft 41 with respect to the body 34. A coupler 71 of the axial retention feature 125 is preferably formed unitarily to the cam member 44 as one piece and thereby axially retains the cam member 44 to the leading end portion 42, and a unitary, radially, enlarged cap 70 of the axial retention feature 125 preferably forms to the trailing end portion 64 as one singular piece with the shaft. Together, the coupler 71 and the cap 70 of the axial retention feature 125 prevent or limit axial movement of the shaft in either direction.

A rotation restriction feature 94 (see FIGS. 13 and 14) is carried between a non-circular continuous wall 98 of the collar portion 84 of the throttle lever 74 and the non-circular trailing end portion 64 of the throttle shaft. The rotation restriction feature 94 preferably has two substantially diametrically opposed flat faces 100, 102 carried by the collar portion 84 and disposed substantially parallel to one another and to the throttle shaft 40. Two diametrically opposed flat sides 104, 106 of the rotation restriction feature 94 are carried by the trailing end portion 64 and preferably extend axially to the end cap 70. When the throttle lever 74 is assembled to the throttle shaft 40, the faces 100, 102 of feature 94 are in tight contact with the respective flat sides 104, 106 of feature 94, thus substantially eliminating slop and preventing rotation of the throttle lever 74 relative to the throttle shaft 40, and the throttle lever 74 is abutted axially against the end cap 70 preventing axial movement of the lever with respect to the shaft 40.

Referring to FIGS. 1-4 and 15-18, the cam member 44 has a substantially cylindrical collar 108, which is shared by the coupler 71, and a hole 110 for tight receipt of the leading end portion 42 of the throttle shaft 40. A cam follower arm 112 of the cam member 44 projects radially outward from the collar 108 for direct engagement with the peripheral cam surface 109 of the choke lever 76 (see FIG. 10). A rotation restriction feature 114 is carried between the cam member 44 and the non-circular leading end portion 42 for preventing rotation of the cam member 44 with respect to the shaft 40 when assembled. The rotation restriction feature 114 preferably has two opposing flat surfaces 118, 120 carried by the cam member 44 and facing radially inward and disposed substantially parallel to the throttle shaft 40. Two diametrically opposed flat sides 122, 124 of the rotation restriction feature 114 are provided adjacent to the leading end portion 42 and mate with the flat surfaces 118, 120 of feature 114, thereby preventing rotation of the cam member 44 relative to the throttle shaft 40.

Figure 15:
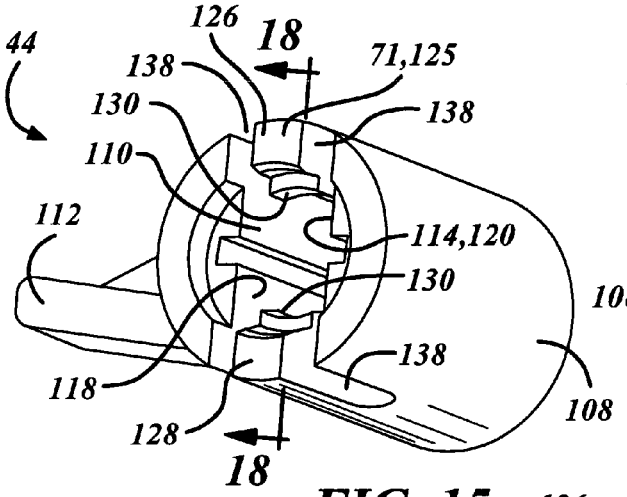
FIG. 15 is a perspective view of the interfacing cam member of the throttle valve.
Figure 16:
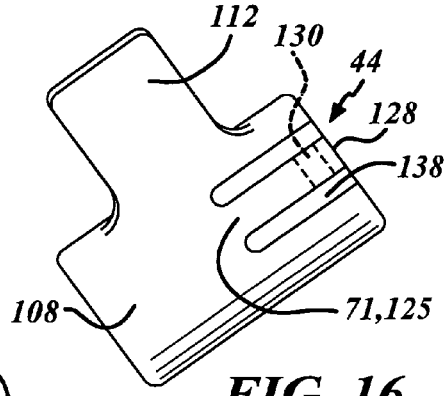
FIG. 16 is a side view of the interfacing cam member.
Figure 18:
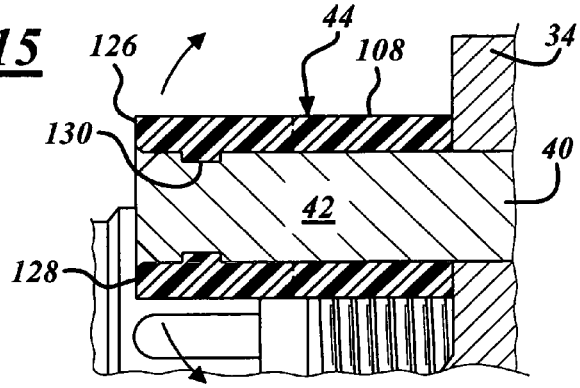
FIG. 18 is a cross section of the interfacing cam member taken along line 18-18 of FIG. 15 and received on the throttle shaft.
Figure 17:
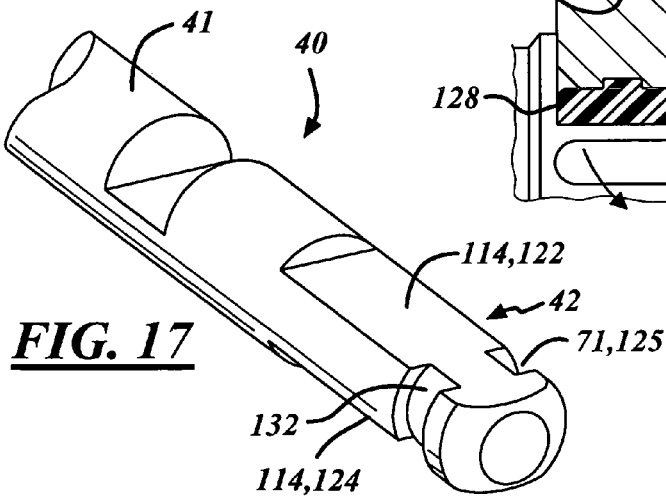
FIG. 17 is a fragmentary perspective view of an opposite end portion of the throttle shaft.

As best shown in FIGS. 15 and 18, the coupler 71 of the axial retention feature 125 has two diametrically opposed and axially extending resilient flex arms or bayonets 126, 128. Each flex arm 126, 128 preferably carries a radially inward projecting tang 130 at their distal ends that snap lock into an indent or circumferentially extending groove 132 of the coupler 71 carried by the leading end portion 42 of the throttle shaft 40. The flexible lock arms 126, 128 are circumferentially spaced from the flat surfaces 118, 120 and are defined by axially extending slits 138 in the cylindrical collar 108. The cam member 44 and the flex arms 126, 128 are preferably one-piece and made of injection molded plastic. One skilled in the art would now know that placement of the groove 132 and tang 130 could be reversed, however, torsional and axial retention strengths could be compromised. Moreover, one skilled in the art would now know that the flex arms 126, 128 of the coupler 71 need not be unitarily fixed to the cam member 44 but could, for example, project from a cylindrical collar dedicated for the coupler and thus not needing a rotation restriction valve.

For purpose of assembly, the throttle shaft 40 is generally of a stepped-construction having axial cross sections generally increasing in the following order of shaft portions; leading end portion 42, mid section 41, trailing end portion 64, and the unitary cap 70 as having the largest axial cross section. Because no shaft portion projects radially outward further than the adjacent shaft portion having a larger cross section, the throttle valve 52 is easily assembled. During assembly of the throttle lever 74 to the trailing end portion 64 of the shaft 40, and before the shaft 40 is inserted into the carburetor body 34, the shaft 40 is inserted through a non-circular hole 86 in the collar portion 84 of the throttle lever 74 with the leading end portion 42 inserted first, then followed by the mid section 41. Because of the stepped-construction of the shaft 40 and because hole 86 is thus larger than mid section 41 and end portion 42, the leading end portion 42 and the mid section 41 conveniently fit loosely through the hole 86 of the throttle lever 74.

For easy assembly and reliable operation of the control valve assembly, the throttle leading end portion 42 has an axial cross section or radial profile that does not extend laterally beyond the throttle shaft mid-section 41. The trailing end portion 64 of the throttle shaft 40 has a cross section that is generally larger than the cross section of the shaft mid-section 41, thus making it relatively simple to slide the throttle lever 74 over the smaller cross-sectioned leading end portion 42 and mid-section 41. Also, the larger hole 86 is thus defined in part by larger flat faces 100, 102 of the rotation restriction feature 94 that generally provides greater torsional strength of the throttle lever 74 at the head end portion 64 where needed and compared relatively to the leading end portion 42. That is, the torsional strength of the throttle lever 74 is greater than the torsional strength of the control lever 44 because the rotation restriction feature 94 is generally larger.

With the carburetor assembled, the throttle lever 74 is axially biased against the unitary cap 70 by slight axial compression of the torsion spring 75 that is compressed axially between the throttle lever 74 and the carburetor body 34 to take up any axial slop. Although slightly compressed, the windings of the torsion spring 75 are preferably slightly spaced axially from one another to prevent the throttle valve 52 from binding with the body when the spring is further coiled during rotation of the throttle valve in the opening direction. That is, during operation of the carburetor, when the throttle valve 52 is rotated toward the wide open throttle position against the biasing force of the coiled torsion spring 75, coils of the spring 75 tighten thus the spring has a tendency to exert an axial force against the throttle lever 74 that in turn exerts the same axial force against the unitary cap 70 of the throttle shaft 40 and that is reacted against the carburetor body 34. This axial force has a tendency of axially shifting the throttle shaft 40 in an outward direction from the body 34. Any axial outward shift, however, is prevented by the flex arms 126, 128 of the coupler 71 that snap lock into the groove 132 carried by the leading end portion 42.

The leading end portion 66 of the choke shaft has a substantially cylindrical axial cross section that is substantially equivalent to or less than the cross section of the choke shaft mid-section 55. The head end portion 62 has a non-cylindrical cross section having an area that is generally larger than that of the mid-section 55. This enables easy axial insertion of the choke shaft 54 into the choke lever 76 with the leading end portion 66 inserted first and followed by the mid-section 55 before rotational alignment at the head end portion 62 is required for further axial insertion. Like the throttle valve 52, the choke lever 76 is rotationally aligned to the head end portion 62 as opposed to the smaller leading end portion 66 for greater torsional strength.

During assembly of the control valve assembly 36 the throttle lever 74 is first slid axially over the leading end portion 42 and aligned with the trailing end portion 64 and is axially moved until it abuts the end cap 70. The coil spring 75 is then slid over the leading end portion 42 and engaged at one end to either the throttle lever 74 or the trailing end portion 64. The throttle shaft 40 is then inserted into the through-bore 56 of the body 34 until the leading end portion 42 projects from the opposite side of the body 34 and an opposite end of the spring 75 engages the body 34. The cam member 44 is then circumferentially aligned to the shaft and slid axially over the leading end portion 42 as the flex arms 126, 128 of the coupler 71 resiliently flex radially outward in the direction of arrows 170 (see FIG. 18). When the tangs 130 of the flex arms 126, 128 axially align with the groove 132 of the coupler 71, the arms return to their unflexed state placing the tangs 130 in groove 132 and removably locking the cam member 44 to the shaft 40. Assembly of the choke valve 46 is performed in a similar matter except in a substantially opposite direction with respect to the carburetor body 34 and the coupler 71 is generally replaced at the opposite side of the body 34 with the conventional e-clip 80.

The shafts 40, 54, coupler 71, cam member 44, throttle lever 74 and choke lever 76 can be formed from any suitable polymeric material with currently preferred materials including, without limitation, acetal copolymers such as those sold under the trademarks Delrin 500 and Celcon M-90. The valve plates 38, 68 may also be formed of brass or other metal. Desirably, the control valve assembly 36 can be assembled without the use of any fasteners, adhesives or the like. Further, the use of machined, stamped or other costly to manufacture components can be at least substantially reduced, and preferably eliminated. Still further, the valve head and shaft can be used with a wide range of interfacing cams and levers to increase the versatility of the control valve assembly 36 for a wide range of carburetors and engine applications. Accordingly, the cost to manufacture and assemble the control valve assembly itself as well as to install the control valve assembly 36 into a carburetor is significantly reduced. The polymeric materials are also cheaper and have greater resistance to corrosion than their metal counterparts.

While the forms of the invention herein disclosed constitute a presently preferred embodiment, many others are possible. For instance, the control valve assembly 36 is not limited to carburetors having both a throttle valve 52 and a choke valve 46 but may include control valve assemblies having only one valve generally known as a throttling choke valve (see U.S. Pat. No. 7,028,993 incorporated by reference herein in its entirety). Moreover, the coupler 71 need not be integral to a cam member 44 of the throttle valve 52 and instead, novel aspects of the coupler 71 can be incorporated into the choke lever 76 by eliminating the e-clip 80 and generally reversing placement of the end cap 32 on the choke shaft 54. It is not intended herein to mention all the possible equivalent forms, modifications or ramifications of the invention. It is understood that terms used herein are merely descriptive, rather than limiting, and that various changes may be made without departing from the spirit or scope of the invention as defined by the following claims.

We claim:

1. In a combustion engine carburetor having a body with a fuel-and-air mixing passage extending therethrough and a control valve assembly constructed and arranged in part in the fuel-and-air mixing passage for control of flow through the fuel-and-air mixing passage and to a combustion engine, the control valve assembly comprising:

a shaft extending transversely across the fuel-and-air mixture passage and supported rotatably by the body about an axis;

a first end portion of the shaft projecting outward from the body;

an opposite second end portion of the shaft projecting outward from the body;

an axial retention feature having a radially enlarged cap formed unitarily as one piece to the first end portion; and a disengageable coupler engaged to the second end portion.

2. The control valve assembly set forth in claim 1 further comprising the coupler having a collar disposed about the second end portion and at least one flex arm projecting from the collar for axial retention of the collar to the shaft.

3. The control valve assembly set forth in claim 2 further comprising at least one radially projecting control lever engaged removably to at least one of the first end portion or the second end portion.

4. The control valve assembly set forth in claim 3 wherein the collar of the coupler is unitarily formed to a control lever of the at least one control levers.

5. The control valve assembly set forth in claim 3 further comprising a rotation restriction feature carried between the at least one control lever and the respective at least one of the first end portion or the second end portion.

6. The control valve assembly set forth in claim 4 further comprising the control lever of the at least one control levers has a rotation restriction feature carried between the control lever and the second end portion.

7. The control valve assembly set forth in claim 5 further comprising the rotation restriction feature having at least one flat side carried by the respective at least one of the first end portion or the second end portion facing radially outward and extending axially, and at least one flat surface carried by the at least one control lever, and wherein each one of the at least one flat surfaces are aligned circumferentially to and disposed against each respective one of the at least one flat sides.

8. The control valve assembly set forth in claim 2 wherein the at least one flex arm projects axially.

9. The control valve assembly set forth in claim 6 wherein the collar has a non-circular hole for receipt of the shaft.

10. The control valve assembly set forth in claim 9 wherein the control lever of the at least one control lever is a cam member having a follower arm projecting radially outward from the collar independent from the at least one flex arm.

11. The control valve assembly set forth in claim 10 further comprising the coupler having a groove opened radially outward from the first end portion and a tang projecting radially inward from a distal end of the at least one flex arm for snap receipt into the groove.

12. The control valve assembly set forth in claim 6 wherein the control valve assembly has a throttle valve having the shaft and the control lever.

13. The control valve assembly set forth in claim 12 wherein the control lever is a fast idle cam member having a follower arm projecting radially outward from the collar for camming contact with a second control lever of the at least one control levers associated with a choke valve having a second rotating shaft supported by the body of the carburetor.

14. The control valve assembly set forth in claim 13 further comprising a throttle lever being one of the at least one control levers attached to the second end portion of the shaft of the throttle valve and disposed axially between the unitary cap and the body.

15. The control valve assembly set forth in claim 14 further comprising a spring wound about the shaft, disposed axially between the throttle lever and the cam member, and engaged between the throttle lever and the body for yieldably biasing the throttle lever to an idle position.

16. A combustion engine carburetor comprising:

a body;

a fuel-and-air mixing passage through the body;

a through-bore communicating through the body and extending across the fuel-and-air mixing passage; and a valve for controlling flow through the fuel-and-air mixing passage, the valve having:

a shaft journaled for rotation to the body about an axis and in the through-bore, the shaft having leading and trailing end portions projecting outward from the body in opposite directions;

a cross sectional area of the leading end portion orientated perpendicular to the axis being less than a cross sectional area of the trailing end portion orientated perpendicular to the axis, a control lever engaged to the leading end portion, a rotation restriction feature carried between the leading end portion and the control lever, and axial retention feature carried at least in part between the leading end portion and the control lever.

17. The combustion engine carburetor set forth in claim 16 wherein the valve is a throttle valve.

18. The combustion engine carburetor set forth in claim 17 wherein the control lever is a member being in rotational contact with a choke valve.

19. The combustion engine carburetor set forth in claim 18 further comprising a coupler of the axial retention feature formed at least in part unitarily to the member and snap fitting removably to the leading end portion.

20. The combustion engine carburetor set forth in claim 19 further comprising a mid section of the shaft located in the through-bore, extending between the leading and trailing end portions and having a cross sectional area disposed perpendicular to the axis that is larger than the cross sectional area of the leading end portion and smaller than the cross sectional area of the trailing end portion, and wherein the through-bore is closely fitted to the mid section.

21. The combustion engine carburetor set forth in claim 20 further comprising a throttle lever engaged to the trailing end portion.

22. The combustion engine carburetor set forth in claim 21 further comprising:

the axial retention feature having a radially enlarged cap formed unitarily to the trailing end portion of the shaft of the throttle valve as one piece;

the throttle lever being removable from the shaft of the throttle valve and located axially between the cap and the body; and a rotational retention feature carried between the trailing end portion and the throttle lever to prevent rotation of the throttle lever with respect to the shaft.

23. The combustion engine carburetor set forth in claim 22 further comprising a plate of the throttle valve disposed pivotally in the fuel-and-air mixing passage and engaged to the mid-section of the shaft.

24. The combustion engine carburetor set forth in claim 23 further comprising:

a slot communicating laterally through and extending axially with respect to the mid-section of the shaft and located in the fuel-and-air mixing passage; and the plate press fitted into the slot.

25. The combustion engine carburetor set forth in claim 22 further comprising a spring wound about the shaft and disposed axially between the throttle lever and the body for yieldably biasing the throttle valve into an idle position.

26. The combustion engine carburetor set forth in claim 22 further comprising:

the choke valve having a choke shaft journaled to the body through a through-bore and having a first end portion projecting outward from the body, an opposite second end portion projecting outward from the body, an enlarged end cap projecting radially outward from and formed unitarily to the first end portion so that the choke shaft and the end cap are one piece; and the choke valve having a choke lever engaged to the first end portion of the choke shaft and disposed between the enlarged end cap and the body wherein the first end portion extends through the choke lever and is circumferentially engaged to the choke lever to prevent rotation of the choke lever with respect to the choke shaft and is axially retained by the end cap.

27. The combustion engine carburetor set forth in claim 26 further comprising a choke spring wound about the first end portion and disposed axially between and engaged to the choke lever and the body.

28. The combustion engine carburetor set forth in claim 27 further comprising a retaining clip snap fitted into a continuous groove carried by the second end portion for preventing the choke shaft from moving out of the body.

29. The combustion engine carburetor set forth in claim 19 further comprising at least one flex arm of the coupler having a tang projecting radially inward from a distal end of the at least one flex arm and snap fitted into a groove of the coupler carried by the leading end portion of the throttle shaft.

30. The combustion engine carburetor set forth in claim 29 further comprising:

the at least one flex arm being two diametrically opposed flex arms projecting axially outward with respect to the body; and the member having two rigid axially projecting shanks orientated circumferentially between the two flex arms.

31. The combustion engine carburetor set forth in claim 30 further comprising two diametrically opposed flat surfaces of the rotation restriction feature carried by the two shanks and confronting respective flat sides of the rotation restriction feature carried by the leading end portion.

32. A method of assembling in a carburetor having a body with a fuel-and-air mixing passage in the body, a control valve assembly comprising the steps of:

unitarily forming as one piece a shaft having an enlarged end cap at a trailing end portion;

inserting an opposite leading end portion of the shaft through a control lever;

circumferentially aligning the control lever to the trailing end portion and axially inside of the end cap so that the control lever does not rotate with respect to the shaft;

axially abutting the control lever to the enlarged end cap;

inserting the leading end portion of the shaft through a coiled spring;

inserting the leading end portion into the carburetor body, through the fuel-and-air mixing passage in the body and until the leading end portion projects outward from the body; and engaging opposite ends of the coiled spring between the control lever and the body for rotatably biasing the shaft.

33. The method of assembling the carburetor control valve assembly set forth in claim 32 comprising the further steps of:

circumferentially aligning a cam member to the leading end portion;

sliding the cam member axially onto the leading end portion; and snap fitting a coupler carried at least in part by the cam member to the leading end portion for axial retention.

34. The method of assembling the carburetor control valve assembly set forth in claim 33 comprising the further steps of:

resiliently flexing at least one flex arm of the coupler radially outward as the cam member slides axially onto the leading end portion; and snap fitting a tang of the at least one flex arm radially into a recess in the leading end portion as the cam member axially aligns to the leading end portion and the at least one flex arm radially moves back into a natural state.

* * * * *